US006435929B1

(12) United States Patent
Halford

(10) Patent No.: US 6,435,929 B1
(45) Date of Patent: Aug. 20, 2002

(54) TOY VEHICLE CRASHSET HAVING REBOUND MECHANISM

(75) Inventor: Wayne Halford, Hermosa Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/633,049

(22) Filed: Aug. 4, 2000

(51) Int. Cl.[7] ..... A63H 17/02

(52) U.S. Cl. ..... 446/6; 446/437; 446/444; 273/129 V; 273/127 A; 273/108.53

(58) Field of Search ..... 446/437, 444, 446/486, 429, 6, 4; 273/129 W, 129 V, 129 S, 129 R, 127 R, 127 A, 108.1, 108.53

(56) References Cited

U.S. PATENT DOCUMENTS

| | | | | |
|---|---|---|---|---|
| 2,716,840 A | | 9/1955 | Armstrong | |
| 3,235,259 A | | 2/1966 | Glass et al. | |
| 3,734,500 A | | 5/1973 | Cooper | |
| 3,789,540 A | | 2/1974 | Convertine et al. | |
| 3,908,303 A | | 9/1975 | McKay et al. | |
| 4,108,437 A | | 8/1978 | DeAnda et al. | |
| 4,229,005 A | | 10/1980 | Barlow et al. | |
| 4,513,967 A | | 4/1985 | Halford et al. | |
| 4,519,789 A | | 5/1985 | Halford et al. | |
| 4,558,867 A | | 12/1985 | Hippely | |
| 4,605,229 A | | 8/1986 | McKay | |
| 4,690,658 A | | 9/1987 | Crosson et al. | |
| 4,715,843 A | | 12/1987 | Ostendorff et al. | |
| 5,052,973 A | | 10/1991 | Rudell et al. | |
| 5,234,216 A | | 8/1993 | Ostendorff | |
| 5,254,030 A | | 10/1993 | Ostendorff et al. | |
| 5,460,560 A | | 10/1995 | Liu | |
| 5,899,789 A | * | 5/1999 | Rehkemper et al. | 446/431 |
| 6,241,573 B1 | * | 6/2001 | Ostendorff et al. | 446/429 |

* cited by examiner

*Primary Examiner*—Jacob K. Ackun
(74) *Attorney, Agent, or Firm*—Roy A. Ekstrand

(57) ABSTRACT

A generally rectangular base supports a pair of gateways at two corners thereof and a pair of resiliently powered impact-responsive rebounders at the remaining two corners thereof. A flat surface extends between the rebounders and the gateways. A pair of toy vehicle launchers and track segments are operatively coupled to each of the gateways to launch toy vehicles therethrough. A plurality of elastic bands extend between the gateways to provide resilient boundaries for the rectangular base. The rebounders and the gateways include pivotal supports allowing the track segments and launchers as well as the rebounders to be pivoted for aiming purposes. A toy vehicle launched by a launcher traverses its track segment and enters its gateway. Thereafter, it strikes either a resilient boundary or a rebounder and is deflected accordingly. An additional toy vehicle launched from the second launcher may collide with or otherwise interact with the first launched toy vehicle.

16 Claims, 3 Drawing Sheets

TOY VEHICLE CRASHSET HAVING REBOUND MECHANISM

CROSS-REFERENCE TO RELATED APPLICATIONS

This application discloses apparatus described and claimed in a related patent application entitled TOY VEHICLE HAVING IMPACT RESPONSE FEATURE filed Aug. 4, 2000 and having application Ser. No. 09/633,041 which is incorporated herein by reference.

FIELD OF THE INVENTION

This invention relates generally to toy vehicle playsets and particularly to those utilizing impacting toy vehicles known generally as crashsets.

BACKGROUND OF THE INVENTION

Toy vehicle playsets are well known in the art and have proven to be an extremely popular and long lasting toy product. In response to this long term popularity, practitioners in the toy arts have provided a virtually endless variety of toy vehicle tracksets and toy vehicle playsets. In many toy vehicle playsets, toy vehicles are provided which are unpowered or free-wheeling while in other toy vehicle playsets, self-powered toy vehicles are employed. Many free-wheeling toy vehicles are acted upon by some type of accelerator or launcher to propel the toy vehicle down the trackway. The tracks and trackways themselves are also subject to considerable variety. However, most are generally formed of a molded plastic material or the like and define a road surface having side rails or guides raised on each side thereof. The sidewalls or guides function to direct the toy vehicle along the roadway. In many toy vehicle playsets, the trackway is formed as a closed circuit and the toy vehicles are operated in continuous laps upon the trackway circuit.

As the popularity of toy vehicle playsets continued to increase, practitioners in the art continued to direct evermore creative efforts toward enhancing the amusement and play value of such toy vehicle playsets. One type of toy vehicle playset enhancement utilized one or more stunts or tricks within the operation of the toy vehicles. A common type of stunt employed in toy vehicle playsets is often referred to a "crashset". Such toy vehicle playsets acquire their name from the utilization of a plurality of toy vehicles operating upon common track segments and encountering various types of intersections which present the opportunity for collision or impact. For example, U.S. Pat. No. 4,513,967 issued to Halford, et al. sets forth a TOY VEHICLE GAME WITH LAUNCHER AND RETURN MEANS having a pair of track segments each having a vehicle launcher at one end and a rebound device at the opposite end in which the track segments cross at a common intersection. A pair of toy vehicles are launched by competing players down the track segments toward the rebound unit and pass through the common intersection. Players take turns attempting to either cause or avoid as the preference may be the occurrence of a collision at the intersection. A vehicle clearing the intersection rebounds off the rebound unit and again returns to the launcher through the intersection.

U.S. Pat. No. 5,234,216 issued to Ostendorff sets forth a TOY VEHICLE CRASH SIMULATING PLAYSET having a launcher coupled to a track segment and a jump ramp together with a receiving ramp spaced from the jump ramp coupled to a simulated group of toy vehicles positioned within the travel path of the receiving ramp. Toy vehicles are launched from the launcher jumping between the launch and receiving ramps and thereafter traveling to impact the simulated toy vehicles at the end of the receiving ramp track portion.

U.S. Pat. No. 3,734,500 issued to Cooper sets forth a COMPETITIVE VEHICLE DEMOLITION GAME having a closed loop multiply intersecting toy vehicle trackway having a pair of separate vehicle lanes defined therein. A plurality of toy vehicles are operative on the trackway and are capable of impacting or colliding at the various intersections. The toy vehicles are fabricated of a plurality of parts maintained in attachment against a spring mechanism. When impacted, the mechanism releases the spring causing the toy vehicle parts to simulate an explosion.

U.S. Pat. No. 4,295,292 issued to Fitzgerald, et al. set forth a DEMOLITION DERBY TOY in which toy vehicles are positioned on a game board and driven by means of a manually operated magnetic manipulator. The manipulators are positioned beneath the game board and are operated by each player. Each vehicle includes a plurality of identical removable elements which are released upon impact to scatter.

Another popular stunt apparatus for toy vehicle playsets is often referred to in the art as "jumpsets". Such stunt apparatus acquire their name from the utilization of one or more trackset gaps together with launching and receiving ramps for causing the toy vehicles to go airborne through the jump feature. For example, U.S. Pat. No. 4,519,789 issued to Halford, et al. sets forth COMBINED JUMP MEANS AND TOY VEHICLE WITH SIMULATED STUNT HOOP having a supporting frame from which an annular stunt hoop is assembled. A toy vehicle trackset includes a launch ramp positioned on one side of the hoop and a receiving ramp positioned on the opposite side of the hoop. Toy vehicles are launched onto the jump ramp and thereafter traverse the span between the launch ramp and receiving ramp and pass through the open center of the hoop.

U.S. Pat. No. 4,558,867 issued to Hippely sets forth a TOY VEHICLE TRACKWAY SET having a jump station which defines a vertical loop coupled to a horizontal loop. The horizontal loop terminates in an upwardly directed ramp such that a toy vehicle launched into the vertical loop passes onto the horizontal loop and is launched through the opening of the vertical loop. A separate catching basket is provided to receive the jumping toy vehicle.

U.S. Pat. No. 4,715,843 issued to Ostendorff, et al. sets forth a TOY VEHICLE PLAYSET having a roadway, a booster for impelling a vehicle along the roadway, a ramp positioned in the roadway to provide a path for the vehicle to leap a predetermined distance, a catcher positioned in the roadway and a return portion slanted to stop the vehicle and return it to the end of the roadway at which the booster is situated.

Toy vehicle playsets utilizing free-wheeling unpowered toy vehicles typically utilize one of a variety of different types of toy vehicle launchers to impart energy thereto. Such toy vehicle launchers have been provided in a variety of different configurations. For example, U.S. Pat. No. 5,254,030 issued to Ostendorff, sets forth a RAPID ACTION TOY VEHICLE LAUNCHER which provides a rapid fire launcher having a pair of magazine ramps feeding successive toy vehicles to the launching station.

Other examples of toy vehicle launchers are found in U.S. Pat. No. 5,460,560 issued to Liu and entitled SPARKING TOY VEHICLE AND LAUNCHER THEREFOR; U.S. Pat. No. 5,052,973 issued to Rudell, et al. and entitled TOY CAR LAUNCHER WITH CABLE-DRIVEN SHUTTLE AND PULLEYS; U.S. Pat. No. 4,690,658 issued to Crosson, et al. entitled TOY CAR LAUNCHER WITH EXPANDABLE SCISSORS MEMBERS; U.S. Pat. No. 4,605,229 issued to McKay entitled TOY DRAGSTRIP AND STARTING TOWER; U.S. Pat. No. 3,789,540 issued to Convertine, et al. entitled COMPRESSED AIR PROPELLED TOY VEHICLE AND LAUNCHING SYSTEM; U.S. Pat. No. 3,908,303 issued to McKay, et al. entitled SHIFT CONSOLE INCLUDING MEANS FOR FEEDING AND LAUNCHING VEHICLES; and U.S. Pat. No. 4,108,437 issued to DeAnda, et al. entitled TOY VEHICLE STARTING AND LAUNCHING SET.

While the foregoing described prior art devices have to some extent improved the art and in many instances enjoyed commercial success, there remains nonetheless a continuing need in the art for evermore improved, interesting and amusing toy vehicle playsets.

SUMMARY OF THE INVENTION

Accordingly, it is a general object of the present invention to provide an improved toy vehicle playset. It is a more particular object of the present invention to provide an improved toy vehicle playset which functions to provide a crashset play pattern and which utilizes rebounding apparatus.

In accordance with the present invention, there is provided a toy vehicle crashset comprising: a toy vehicle; a base defining a surface and a periphery; at least one gate supported by the base having a pivot member constructed to guide the toy vehicle onto the surface; a toy vehicle launcher and a track segment coupled to the at least one gate, the toy vehicle launcher and the track segment and the at least one gate cooperating to propel the toy vehicle through the at least one gate and across a portion of the surface; a resilient barrier supported upon the base extending about at least a portion of the periphery; and at least one rebounder supported upon the base having a resiliently-driven impact-responsive ram, the toy vehicle crossing a portion of the surface and rebounding from impact against the resilient barrier or the rebounder.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
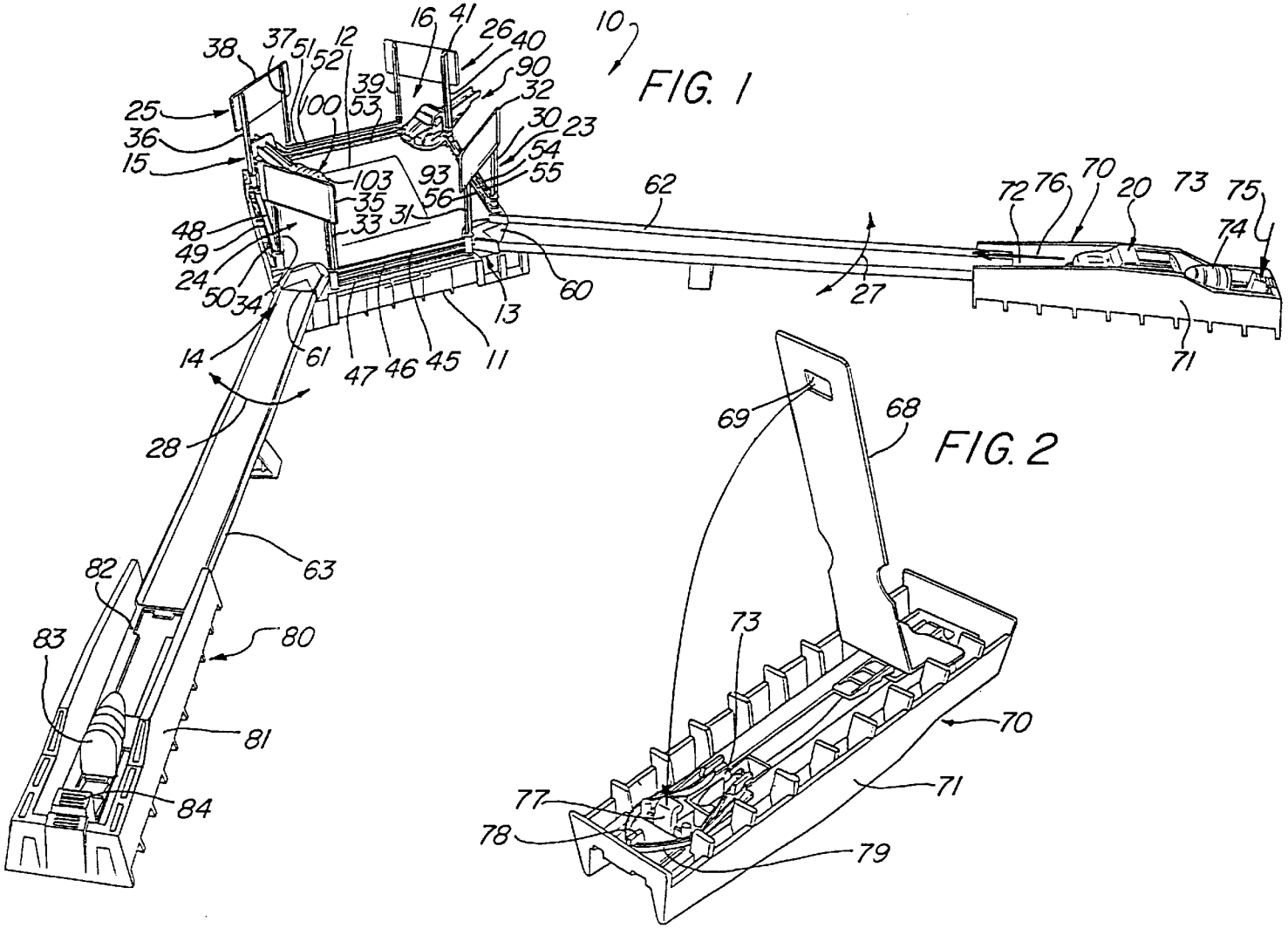
FIG. 1 sets forth a perspective view of a toy vehicle crashset constructed in accordance with the present invention.
FIG. 2 sets forth a perspective bottom view of a typical toy vehicle launcher utilized in the present invention toy vehicle crashset.

FIG. 1 sets forth a perspective view of a toy vehicle crashset constructed in accordance with the present invention and generally referenced by numeral 10. Crashset 10 includes a generally rectangular base 11 defining a generally planar surface 12. A plurality of gates 13, 14, 15 and 16 are positioned upon the four corners of base 11. Gate 13 includes a pivot 60 secured to a track 62 which in turn is secured to a launcher 70. A gateway 23 formed of a pair of posts 30 and 31 and a panel 32 is positioned above gate 13. Similarly, gate 14 includes a pivot 61 having a track 63 coupled to a launcher 80. Gate 14 further includes a gateway 24 formed by a pair of posts 33 and 34 together with a panel 35. Gate 15 includes a gateway 25 formed by a pair of posts 36 and 37 and a panel 38 while gate 16 includes a gateway 26 formed by a pair of posts 39 and 40 and a panel 41. In accordance with the present invention, gate 15 supports a rebounder 100 while gate 16 supports a rebounder 90.

In further accordance with the present invention, a plurality of stretched rubber bands 45, 46 and 47 extend between posts 31 and 33 while a corresponding set of rubber bands 48, 49 and 50 stretch between posts 34 and 36 and a plurality of rubber bands 51, 52 and 53 stretch between posts 37 and 39. Finally, the enclosure of surface 12 is completed by a plurality of stretched rubber bands 54, 55 and 56 which are stretched between posts 40 and 30. Thus, base 11 is bounded on all four sides by pluralities of stretched rubber bands extending between gates 13 through 16.

Launcher 70 may be fabricated in accordance with conventional fabrication techniques and includes a housing 71 defining a launcher channel 72. A movable slide 73 is coupled to an elastic rubber band 79 (seen in FIG. 2). In accordance with conventional fabrication techniques, slide 73 is drawn rearwardly within channel 72 and is engaged by a release button 74. A toy vehicle 20 is positioned within channel 72 in front of and against slide 33. Thereafter, toy vehicle 20 is launched in the direction indicated by arrow 76 upon track 62 when release button 74 is pressed downwardly in the direction indicated by arrow 75.

Launcher 80 is substantially identical to launcher 70 and includes a housing 81 defining a launch channel 82. Launcher 80 further includes a slide 83 and a release button 84.

Rebounder 90 is set forth below in FIGS. 3 through 7 in greater detail. However, suffice it to note here that rebounder 90 includes a movable ram 93 which in the manner set forth below in greater detail is drawn against a resilient member supported within rebounder 90 and latched in a cocked position. Thereafter, impact against ram 93 causes ram 93 to rapidly move forwardly and across surface 12 against the rebounding object such as a toy vehicle.

Rebounder 100 is similar in fabrication to rebounder 90, described below, and thus includes a movable ram 103 which is resiliently supported against a latch in a cocked position within gateway 25. In a further similar manner, ram 103 of rebounder 100 rapidly moves inwardly across surface 12 against any impacting object such as a toy vehicle or the like.

In operation, a toy vehicle such as toy vehicle 20 is loaded into launcher 70 and launcher 70 is cocked by drawing slide 73 rearwardly against rubber band 79 (seen in FIG. 2). In the preferred operation of the present invention, launcher 80 is similarly loaded with a toy vehicle and is cocked against an internal elastic element identical to rubber band 79 of launcher 70 (seen in FIG. 2). Thereafter, either or both of the toy vehicles within launchers 70 and 80 may be launched down tracks 62 and 63 respectively. If, for example, launcher 70 accelerates toy vehicle 20 in the direction indicated by arrow 76, toy vehicle 20 traverses track 62 and passes through gateway 23 of gate 13 and traverses surface 12. In the event a second toy vehicle is launched from launcher 80, the possibility of a collision upon surface 12 arises. On the other hand, if toy vehicle 20 passes through gateway 23 and traverses surface 12, it is likely to impact either rebounder 100 or one of the pluralities of elastic bands stretched about the periphery of base 11. In the event toy vehicle 20 strikes rebounder 100, ram 103 is released and the toy vehicle is rebounded by the energy of the impacting ram. Another possibility exists that toy vehicle 20 will strike one or more of the sets of elastic bands stretched about the periphery of base 11 and will rebound against rebounder 90. A similar result occurs as rebounder 90 releases ram 93 causing,the toy vehicle to be further bounced about.

In further accordance with the present invention, each operator of launchers 70 and 80 is able to pivot the track and launcher about pivots 60 and 61 respectively as indicated by arrows 27 and 28 respectively. This allows each operator of each of launchers 70 and 80 to apply additional strategy and skill to the operation of crashset 10 by aiming their respective launched toy vehicles to selected portions of the toy vehicle crashset rebounding area.

While the present invention toy vehicle crashset may be operated by a single child user, it is anticipated that the most exciting play results from two children simultaneously operating launchers 70 and 80. The various competitive aspects of the game thus played may, for example, include one competitor attempting to successfully avoid collision while the other endeavors to provoke a collision.

Figure 8:
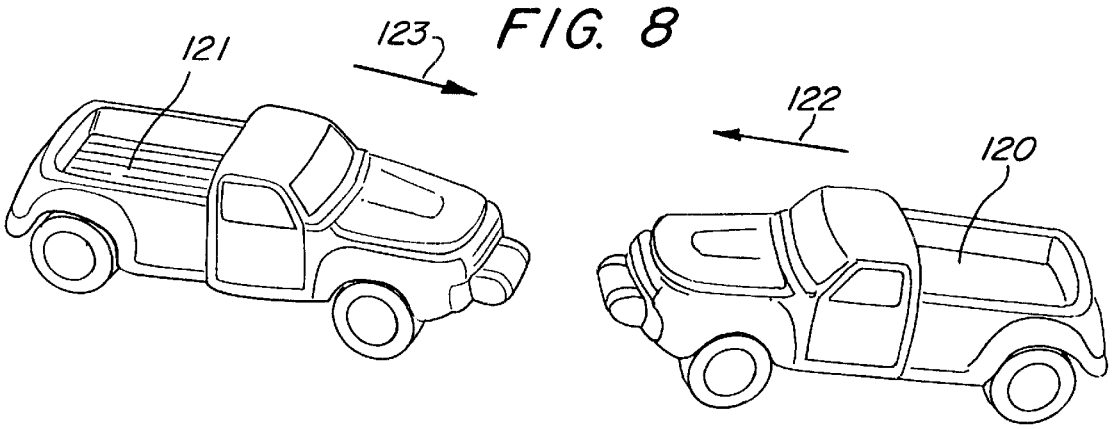
FIG. 8 sets forth a perspective view of a pair of impacting toy vehicles.
Figure 9:
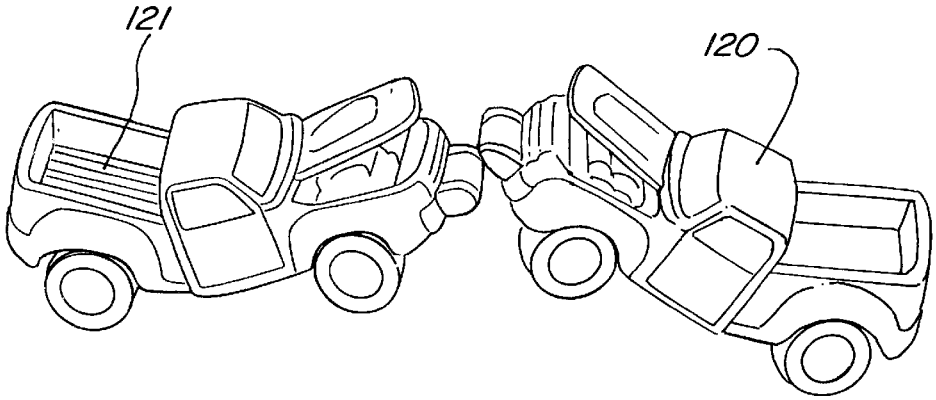
FIG. 9 sets forth a perspective view of the pair of toy vehicles of FIG. 8 following impact.
Figure 10:
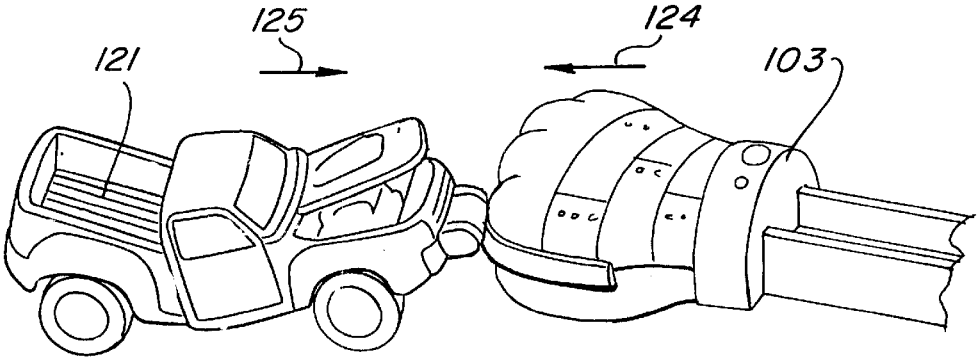
FIG. 10 sets forth a perspective view of a toy vehicle impacting a rebounder utilized in the present invention toy vehicle crashset.

It will be recognized by those skilled in the art that the present invention toy vehicle crashset may be operated with virtually any freewheeling toy vehicle. However, it has been found particularly interesting and amusing to utilize a toy vehicle which itself is impact-responsive and which undergoes some stunt activity such as crash deformation in response to impact. By way of example, FIGS. 8, 9 and 10 set forth illustrative examples of such a toy vehicle. The operative structure of the preferred toy vehicle illustrated in FIGS. 8 through 10 is shown in greater detail in the above-referenced related patent application. However, once again, it must be emphasized that the present invention toy vehicle crashset is capable of operation with a variety of toy vehicles without departing from the spirit and scope of the present invention.

FIG. 2 sets forth a bottom perspective view of launcher 70. It will be recalled that launcher 80 is virtually identical in fabrication to launcher 70. Thus, the description of launcher 70 shown in FIG. 2 will be understood to apply equally well to launcher 80 and be equally descriptive thereof.

More specifically, launcher 70 includes a housing 71 within which a slide 73 is movably supported. Housing 71 further defines a hook 78 which receives the forward end of an elastic member such as a rubber band 79. Rubber band 79 is operatively coupled between hook 78 and slide 73. Launcher 70 further includes a pivotally supported cover 68 having an aperture 69 formed therein. Cover 68 is pivoted upon housing 71 such that a hook 77 passes through aperture 69 and secures cover 68.

Figures 3, 4, 5, 6, 7:
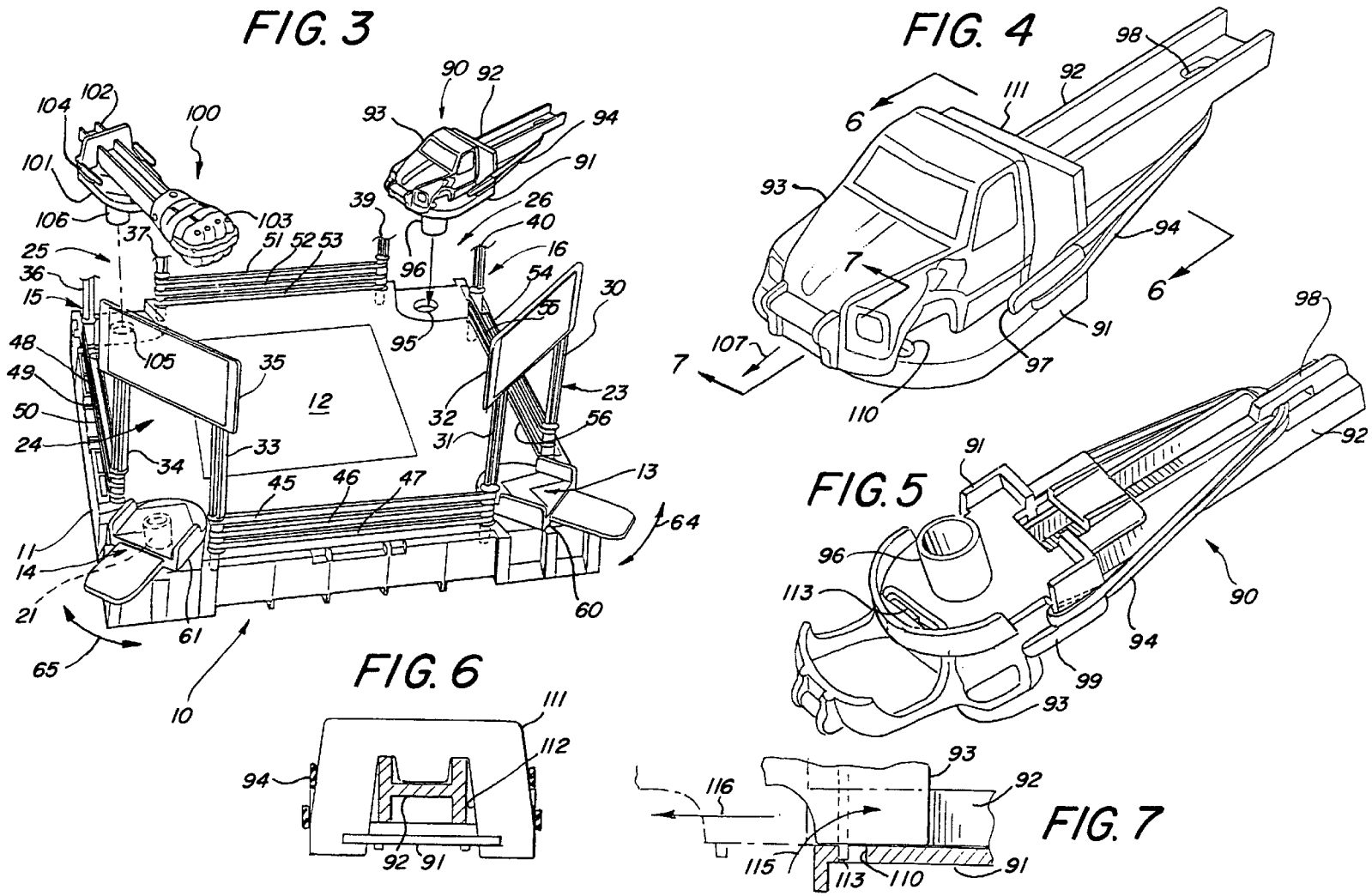
FIG. 3 sets forth a partial perspective assembly view of the present invention toy vehicle crashset.
FIG. 4 sets forth a perspective of a rebounder utilized in the present invention toy vehicle crashset.
FIG. 5 sets forth a bottom perspective of the rebounder of FIG. 4.
FIG. 6 sets:forth a section view of the rebounder of FIG. 4 taken along section lines 6—6 therein.
FIG. 7 sets forth a partial section view of a portion of the rebounder of FIG. 4 taken along section lines 7—7 therein.

FIG. 3 sets forth a partial perspective assembly view of toy vehicle crashset 10. As described above, toy vehicle crashset 10 includes a generally rectangular base 11 having gates 13, 14,, 15 and 16 formed at the corners thereof. Gates 13 through 16 include respective gateways 23 through 26 as set forth above in FIG. 1. Gateway 23 includes a pair of posts 30 and 31 and a panel 32. Similarly, gateway 24 includes posts 33 and 34 and a panel 35. Gateway 25 includes a pair of posts 36 and 37 while gateway 26 includes a pair of posts 39 and 40. Base 11 further defines a generally planar surface 12 which is bounded by a plurality of elastic rubber bands 45 through 56 extending between posts 31 and 33, 34 and 36, 37 and 39, and 40 and 30. Thus, elastic rubber bands 45 through 56 provide resilient enclosure of surface 12.

A pivot 60 is supported within gate 13 and,is pivotal in the manner indicated by arrow 64. Pivot 60 includes conventional means for attachment to a conventional track segment 62 (seen in FIG. 1). Similarly, a pivot 61 supported within gateway 24 is movable in the manner indicated by arrows 65 and in accordance with conventional fabrication techniques is securable to a conventional track segment such as track segment 63 shown in FIG. 1.

A rebounder 90 includes a platform 91 having a post 96 extending downwardly therefrom. Post 96 is received within aperture 95 formed in base 11 within gateway 26. Thus, post 96 allows rebounder 90 to be pivoted within gateway 26. Rebounder 90 includes a ram 93 supported by a shaft 92 in the manner set forth below in FIGS. 4 and 5. Suffice it to note here that ram 93 and shaft 92 are movable with respect to platform 91 and are acted upon by a rubber band elastic member 94. Thus, rebounder 90 is supported within gateway 26 and, in the manner described below, may be cocked by drawing the combined structure of ram 93 and shaft 92 rearwardly against elastic rubber band 94 to latch ram 93 against the force of band 94.

A similar rebounder 100 includes a platform 101 having a post 106. Post 106 is received within an aperture 105 formed upon base 11 within gateway 25. Thus, rebounder 100 is pivotable within gateway 25. In a similar fabrication-to rebounder 90, rebounder 100 includes a ram 103 supported upon platform 101 by a shaft 102. A rubber ban 104 is coupled between platform 101 and shaft 102 to allow ram 103 to be moved outwardly to a cocked position in a similar fashion to rebounder 90.

Rebounders 90 and 100 function in a substantially identical manner and are loaded or cocked by drawing their respective rams outwardly to the latched position. Thereafter, once loaded, an impact by a toy vehicle against either ram 93 or ram 103 releases the ram causing it to rebound the impacting toy vehicle. Once again, it will be noted that the angular position of rebounders 90 and 100 may be adjusted by pivotal movement.

As mentioned above, pivots 60 and 61 are pivotable within gateways 23 and 24 utilizing a structure basically the same as post 96 and aperture 95 shown for rebounder 90. Thus, for example, pivot 61 includes a post 21 received within an aperture (not shown) formed within base 11.

FIG. 4 sets forth a perspective view of rebounder 90. It will be noted that rebounder 90 and rebounder 100 are fabricated in substantially the identical manner with the sole difference being the shape of the respective rams thereof. Thus, ram 93 of rebounder 90 is shown to define a shape resembling the forward cab of a truck. In contrast, ram 103 of rebounder 100 (seen in FIG. 3) defines a shape generally resembling a clenched fist. With the exception of this difference in the shape of the respective ram portions, rebounder 100 will be understood to be substantially identically to rebounder 90 and thus the descriptions of rebounder 90 set forth in conjunction with FIGS. 4 through 7 will be understood to apply equally well and be equally descriptive of rebounder 100.

Returning to FIG. 4, rebounder 100 includes a platform 91 which as is set forth above in FIG. 3 is pivotally secured to base 11 by a post 96 within an aperture 95. Platform 91 includes a pair of hooks 97 and 99 (hook 99 seen in FIG. 5). Platform 91 further includes a plate 111 which, as is better seen in FIG. 6, defines an aperture 112. A slot 110 is formed in the forward portion of platform 91. Rebounder 90 includes a ram 93 secured to an elongated shaft 92. Shaft 92 includes a hook 98 and passes through aperture 112 in the manner seen in FIG. 6. Thus, the combined structure of ram 93 and shaft 92 is slidably supported upon platform 91. As is better seen in FIG. 7, ram 93 further defines a downwardly extending tab 113 which in the cocked position of FIG. 4 is received within slot 110 to restrain the position of ram 93 to that shown in FIG. 4. An elastic member such as a rubber band 94 is secured at opposed ends to hooks 97 and 99 (hook 99 seen in FIG. 5). The intermediate portion of band 94 is received upon hook 98 of shaft 92.

In the cocked position shown in FIG. 4, the rearward extension of shaft 92 stretches band 94 storing energy therein. The force of band 94 urges the combined structure of shaft 92 and ram 93 forwardly. This forward urging is restrained by tab 113 (seen in FIG. 7) within slot 110.

In operation, the energy stored within band 94 is restrained until an impact occurs against the forward portion of ram 93. This impact causes ram 93 to be moved rearwardly and upwardly releasing the lock of ram 93 within slot 110 allowing the energy within band 94 to rapidly move ram 93 forwardly in the direction indicated by arrow 107. Thus, in operation, each time a toy vehicle impacts the frontal portion of ram 93, the ram is released and rebounds against the impacting vehicle sending it flying in the opposite direction.

FIG. 5 sets forth a bottom perspective view of rebounder 90 in the cocked or loaded position. As described above, rebounder 90 includes a platform 91 supporting a post 96 and a pair of hooks 97 and 99 (hook 97 seen in FIG. 4). As is also described above, rebounder 90 includes a ram 93 having a rearwardly extending shaft 92. A hook 98 is formed on shaft 92 and receives the middle portion of an elastic band 94. Band 94 is stretched upon hooks 97 and 99.

Platform 91 defines a slot 110 while ram 93 defines a tab 113. Tab 113 is captive within slot 110 to latch ram 93 against the energy within stretched band 94.

FIG. 6 sets forth a section view of rebounder 90 taken along section lines 6—6 in FIG. 4. As described above, platform 91 supports a plate 111 having an aperture 112 formed therein. As is also described above, a shaft 92 which as is better seen in FIG. 4 supports ram 93 is slidably received within aperture 112. An elastic band 94 is stretched on either side of plate 111.

FIG. 7 sets forth a partial section view of the latching mechanism of rebounder 90 taken along section lines 7—7 in FIG. 4. A platform 91 slidably supports a ram 93 having a shaft 92. Ram 93 supports a downwardly extending tab 113. A slot 110 is formed in platform 91 and receives tab 113 to latch ram 93 and shaft 92 against the stretched force of band 94 (seen in FIG. 4).

In operation, an impact against ram 93 causes an upward and rearward movement of ram 93 in the direction indicated by arrow 115. This upward and rearward movement pivots tab 113 from slot 110 releasing shaft 92 and ram 93. Thereafter, the stored energy within band 94 (seen in FIG. 4) rapidly accelerates ram 93 and shaft 92 in the direction indicated by arrow 116. This rapid movement produces a rebound of the toy vehicle impacting ram 93.

As mentioned above, it will be understood that but for the difference in shapes of their respective rams, rebounders 90 and 100 are substantially identical. Thus, with temporary reference to FIG. 3, rebounder 100 operates in the same manner as rebounder 90 and rapidly moves ram 103 forwardly when ram 103 is impacted by a toy vehicle to cause the toy vehicle to rebound.

FIG. 8 shows a perspective view of a pair of toy vehicles 120 and 121 approaching each other in an imminent collision along paths indicated by arrows 122 and 123. As mentioned above, the present invention crashset is operative with virtually any free-wheeling toy vehicle. It will be equally apparent that in the event a pair of powered vehicles are utilized such as battery and electric motor powered toy vehicles, the present invention crashset is operative without the need for launchers 70 and 80 (seen in FIG. 1).

FIG. 9 shows a perspective view of an impact between toy vehicles 120 and 121. In the preferred vehicle type used in the present invention toy vehicle crashset, a conventional toy vehicle may be replaced by toy vehicles which themselves undergo impact responsive alteration to simulate a vehicle crash.

FIG. 9 sets forth toy vehicles 120 and 121 which are fabricated in accordance with the above-identified related patent application. Accordingly, the toy vehicles have deformed upon impact to resemble crashed vehicles.

FIG. 10 sets forth toy vehicle 121 upon impact and rebound from ram 103. As described above, the impact of toy vehicle 121 against ram 103 when rebounder 90 (seen in FIG. 3) is in the cocked position causes ram 103 to move rapidly in the direction indicated by arrow 124. This, in turn, triggers the crash or impact response of vehicle 121 and causes it to rebound in the general direction of arrow 124.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle crashset comprising:

a toy vehicle;

a base defining a surface and a periphery;

at least one gate supported by said base having a pivot member constructed to guide said toy vehicle onto said surface;

a toy vehicle launcher and a track segment coupled to said at least one gate, said toy vehicle launcher and said track segment and said at least one gate cooperating to propel said toy vehicle through said at least one gate and across a portion of said surface;

a resilient barrier supported upon said base extending about at least a portion of said periphery; and at least one rebounder supported upon said base having a resiliently-driven impact-responsive ram, said toy vehicle crossing a portion of said surface and rebounding from impact against said resilient barrier or said rebounder.

2. The toy vehicle crashset set forth in claim 1 wherein said at least one gate is pivotably secured to said base.

3. The toy vehicle crashset set forth in claim 2 wherein said at least one rebounder is pivotably secured to said base.

4. The toy vehicle crashset set forth in claim 3 wherein said base is generally rectangular and wherein said at least one gate and said at least one rebounder are each positioned on one of the corners of said base.

5. The toy vehicle crashset set forth in claim 4 wherein said resilient barrier extends between adjacent corners of said base.

6. A toy vehicle crashset comprising:

a toy vehicle;

a base defining a surface and a surrounding periphery;

first and second gates supported by said base having first and second respective pivot members each constructed to guide said toy vehicle onto said surface;

first and second toy vehicle launchers having first and second track segments respectively coupled to said first and second pivots;

first and second resiliently-driven impact responsive rebounders supported by said base having first and second rams; and a plurality of resilient barriers extending along portions of said periphery between said first and second rebounders and said first and second gates, each of said first and second launchers launching said toy vehicle through said first and second gates to impact against and rebound from said rebounders and resilient barriers.

7. The toy vehicle crashset set forth in claim 6 wherein said base and said periphery is generally rectangular defining four corners.

8. The toy vehicle crashset as set forth in claim 7 wherein said first and second rebounders and said first and second gates are each supported at one of said corners.

9. The toy vehicle crashset set forth in claim 8 wherein said first and second gates are pivotably supported on said base.

10. The toy vehicle set forth in claim 9 wherein said first and second rebounders are pivotably supported on said base.

11. The toy vehicle set forth in claim 6 wherein said first and second rebounders are pivotably supported on said base.

12. The toy vehicle crashset set forth in claim 8 wherein said first and second gates are pivotably supported on said base.

13. A toy vehicle crashset comprising:

a toy vehicle;

a generally rectangular base defining a generally planar surface, four corners and four sides;

first and second gates supported at different ones of said corners, each gate constructed to guide a toy vehicle onto said surface;

first and second tracks coupled to said first and second gates;

first and second toy vehicle launchers coupled to said first and second tracks;

first and second rebounders having first and second resiliently-driven impacts responsive rams, said first and second rebounders supported on different ones of said corners from those supporting said first and second gates; and four resilient barriers each generally aligned with one of said four sides.

14. The toy vehicle crashset set forth in claim 13 wherein said first and second gates are pivotably supported.

15. The toy vehicle crashset set forth in claim 13 wherein said first and second rebounders are pivotably supported.

16. The toy vehicle crashset set forth in claim 14 wherein said first and second rebounders are pivotably supported.

* * * * *